United States Patent [19]

White

[11] Patent Number: 4,928,773

[45] Date of Patent: May 29, 1990

[54] FIRE SPRINKLER HEAD JIG

[76] Inventor: Jerry H. White, 27911 Paseo El Concho, San Juan Capistrano, Calif. 92675

[21] Appl. No.: 384,306

[22] Filed: Jul. 21, 1989

[51] Int. Cl.[5] ..... A62C 37/12

[52] U.S. Cl. ..... 169/37; 169/41; 169/43

[58] Field of Search ..... 169/16, 19, 37, 43, 169/41, 54, 90

[56] References Cited

U.S. PATENT DOCUMENTS

| | | | |
|---|---|---|---|
| 3,388,747 | 6/1968 | Hodnett | 169/41 |
| 3,393,746 | 7/1968 | Hodnett | 169/41 |
| 3,727,695 | 4/1973 | Danton | 169/37 |
| 4,791,993 | 12/1988 | Curran | 169/37 |

FOREIGN PATENT DOCUMENTS

| | | | |
|---|---|---|---|
| 135397 | 11/1919 | United Kingdom | 169/37 |

*Primary Examiner*—Sherman D. Basinger
*Assistant Examiner*—Stephen P. Avila
*Attorney, Agent, or Firm*—Baker, Maxham, Jester & Meador

[57] ABSTRACT

A sprinkler head jig for installing in place for a fire sprinkler head during construction, comprises a body having dimensions including a length and outer configuration conforming generally to those of a fire sprinkler head to be installed, and conduit means formed in and along the length of said body and having threads on opposite ends thereof for installing in a sprinkler fitting and for receiving a removable closure.

12 Claims, 1 Drawing Sheet

FIRE SPRINKLER HEAD JIG

BACKGROUND OF THE INVENTION

The present invention relates to fire sprinklers and pertains particularly to an improved apparatus and method for the installation of fire sprinkler heads.

Fire sprinkler systems are required in most new high-rise buildings and in most multi-unit residential buildings, whether high-rise or not. Many jurisdictions require the installation of sprinkler systems in the renovation of any building.

Fire sprinker nozzles are usually mounted in the ceiling of a building, with the water supply pipe or conduit being mounted in a space above the ceiling. Most modern commercial buildings have a false (or suspended) ceiling above which the sprinkler pipe is mounted and through which the sprinkler head extends. The suspended ceiling comprises removable panels supported in a suspended frame.

Most residential buildings have a fixed ceiling of either wallboard or lath and plaster through which the sprinkler head extends. The wallboard and lath and plaster is attached to the lower side of ceiling joists. The water pipes are either in the attic or in the space between floor and ceiling in multi-story buildings.

In most new construction, the sprinkler system is installed first, and the ceiling structure is built or fitted around the sprinkler head after it has been installed. This frequently results in many of the sprinkler heads being damaged and inoperative when the building has been completed. It is then necessary to test and replace many of the sprinkler heads. This is expensive and time consuming.

The retrofitting of sprinkler systems in older buildings usually requires the partial removal of the existing ceiling, and the installation of the sprinkler system. The ceiling is then reconstructed over the sprinkler pipes and around the sprinkler heads. The location of holes in ceiling panels for fitting over and around the sprinkler heads is also a difficult task.

The present invention was conceived and developed as a means for overcoming the above-identified problems.

SUMMARY AND OBJECTS OF THE INVENTION

It is the primary object of the present invention to provide an improved apparatus and method for the installation of fire sprinkler heads.

In accordance with a primary aspect of the present invention, a fire sprinkler head jig is provided with the shape and dimension of a sprinkler head to enable installation of the sprinkler system and finished ceiling structures prior to the installation of sprinkler heads.

BRIEF DESCRIPTION OF THE DRAWING

The above and other objects and advantages of the present invention will become apparent from the following description when read in conjunction with the accompanying drawings wherein.

DETAILED DESCRIPTION OF A PREFERRED EMBODIMENT

Figure 1:
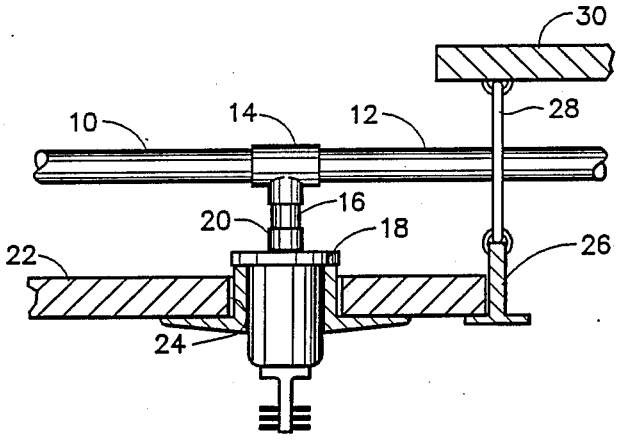
FIG. 1 is a side elevation view partially in section of a typical sprinkler head of a fire sprinkler system installed.

Referring to the drawing, and particularly to FIG. 1, there is illustrated a typical fire sprinkler head installation. The illustration represents an installation in a drop or suspended ceiling installation; however, other ceiling installations are very similar in basic structure, as will be explained. The sprinkler system typically comprises a water supply line or pipe 10, coupled or connected to an adjacent pipe or section 12 by means a T coupling 14. The T couplings 14 are located where sprinkler heads are to be mounted or located in the building, and provide for the coupling of a short pipe or line 16. This pipe or line 16 is typically referred to as a nipple on which is connected a sprinkler head 18 by means of a sleeve or collar coupling 20. The fire sprinkler head 18 is of a typical construction that is normally under pressure, and operates to close off the water supply line until a certain degree of temperature is reached that triggers the sprinkler head to open and release a spray of water throughout an area within a room.

The FIG. 1 illustration shows the sprinkler head 18 extending through and substantially flush with a ceiling panel 22, having a hole or bore 24 fitting snugly around the body of the sprinkler head 18. The sprinkler head 18 is of the type available under the trademark AQUARIUS from Gem Sprinkler Company, Cranston, R.I.

In the illustrated embodiment, the ceiling panel 22 is shown supported in a T-bar frame member 26, typically formed in a grid pattern and supported by means of a plurality of wires 28 from nails or other fixtures in the lower surface of a concrete floor structure 30 of a high-rise building or the like. In such installations, the panel or plurality of panels 22 fit into square or rectangular support frames formed by a plurality or a grid network of the T-bars 26. The T-bars are suspended a distance below the floor of the next space above to provide space for placement of air conditioning, ducting, water lines, electrical conduits, and the like.

In a multi-level dwelling unit, the ceiling would be formed typically of panels of gypsum wallboard nailed directly to the underside of ceiling joists above the room. A space will typically exist between the ceiling joist and the floor above. Frequently, the ceiling and floor of the lower unit and the floor joist of the upper unit are common members. In such cases, the water pipes may extend between the floor joist or through the floor joist.

The nipple 16 is a length to properly position the sprinkler head in relation to the ceiling structure or panel that will form the ceiling surface. In certain structures, the ceiling panel may be of lath and plaster, in which case a support lattice work of lath is attached and suspended from the ceiling joist, and plaster is applied over the lath to form a ceiling surface of a desired texture.

The sprinkler system is typically installed by plumbers after framing, but prior to the hanging of wallboard and the like. Carpenters typically apply the wallboard and plasterers typically apply the plaster type structures.

Figure 2:
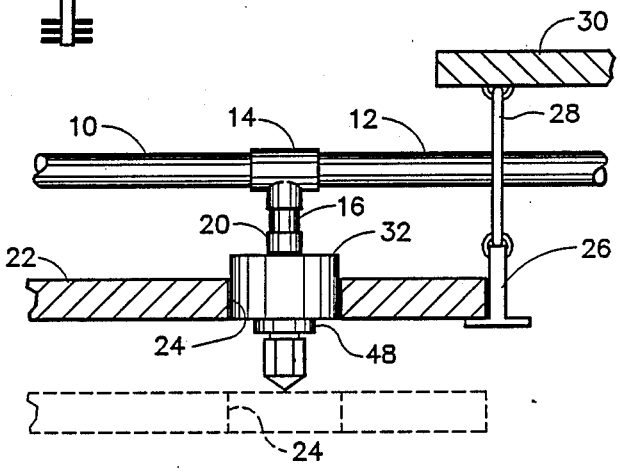
FIG. 2 is a view like FIG. 1 illustrating a preferred embodiment of the invention in use.

Referring to FIG. 2, there is illustrated the structural layout of FIG. 1 wherein a fire sprinkler jig 32 is fitted to the nipple 16 in place of the sprinkler head 18. As soon as the ceiling structure has been completed, the fire sprinkler jig 32, in accordance with the invention, is removed and a sprinkler head 18 is installed.

Figure 3:
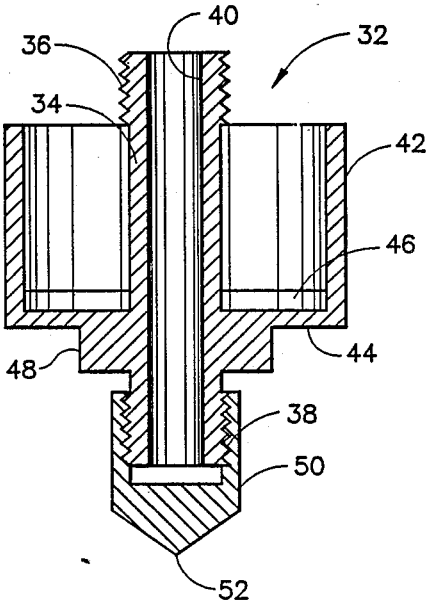
FIG. 3 is a side elevation view in section of the embodiment of FIG. 2.

The sprinkler jig, as best illustrated in FIG. 3, comprises a body member comprising a central tube or conduit 34, having external threads 36 on an upper end and external threads 38 on a lower end. The jig or body member is preferably molded as a unitary structure, with the central conduit or tubular member 34 having a bore 40, and being integrally molded with an upturned skirt 42 open at the top. The barrel or skirt portion of the body is provided with a lower end wall 44, and a plurality of radial ribs 46 reinforcing the wall structure and its support from tube 34.

A hex nut like structure 48 is molded into the lower end of the body member 42 for the receipt of standard size sprinkler head wrenches. The jig member has a length identical to that of the sprinkler head for which the sprinkler system is being fitted. The jig member is secured to the lower end of a nipple 16 of a proper length, to properly position the cylindrical body or barrel member 42 at the proper location for fitting a ceiling surface structure 22 therearound.

The tubular member with bore 40 enables the sprinkler system to be pressure tested and to be drained prior to the installation of the actual sprinkler heads. The jig member itself enables the ceiling structure to be formed and constructed in place about the position for the sprinkler head without damage to a sprinkler head. Thus, the jig forms a mold or form structure around which the ceiling is constructed and fitted forming a cavity or bore 24 to enable the proper location and fitting of a sprinkler head 18. A closure or cap member 50 closes the lower end of the bore 40, and also includes a marking point or probe 52 for engagement of ceiling panels and marking the location of the hole through which the sprinkler head is to extend.

In the location of a hole in a panel 22, shown in phantom with reference to FIG. 2, a panel is positioned below the installed jig 32 and aligned with the frame members 26, and then pressed upward against the point 52. This causes a depression or mark to be formed in the upper surface of the panel to locate the center of the sprinkler head cavity. The panel is then taken down and hole saw may be used to form a hole 24 for fitting around the panel 22. Wallboard may also be installed in a similar manner.

In operation, a sprinkler system is installed as described above, with a plurality of jig members 32 secured in proper position on the ends of the nipples 16, as described above. Closure caps 50 are installed on each of the jig members, and the water lines of the sprinkler system is then tested for leaks. Once all leaks, if any, are corrected, the ceiling may then be installed. After the ceiling is installed and finished, the jig members 32 may be removed, and sprinkler heads 18 installed in their place. This enables the construction of a sprinkler system, and the construction of a ceiling around the sprinkler system prior to the installation of the sensitive sprinkler heads. This eliminates and reduces damage to the sprinkler heads.

While I have illustrated and described my invention by means of specific embodiments, it is to be understood that numerous changes and modifications may be made therein without departing from the spirit and scope of the invention as defined in the appended claims.

I claim:

1. A sprinkler head jig for substituting for a fire sprinkler head during construction, comprising:

a body having dimensions including a length and outer configuration conforming generally to those of a fire sprinkler head to be installed, and conduit means formed in and along the length of said body and having threads on opposite ends thereof for installing in a sprinkler fitting and for receiving a removable closure, wherein said closure is a cap having marking means thereon for marking a panel engaged thereby for locating a hole for receiving said jig.

2. A sprinkler head jig according to claim 1 wherein: the outer configuration of said body is cylindrical.

3. A sprinkler head jig according to claim 1 wherein: said marking means is a point on said head of said cap for engaging and marking a panel.

4. A sprinkler head jig for substituting for a fire sprinkler head during construction, comprising:

a body having dimensions including a length and outer configuration conforming generally to those of a fire sprinkler head to be installed, and conduit means formed in and along the length of said body and having threads on opposite ends thereof for installing in a sprinkler fitting and for receiving a removable closure;

said body has a generally cylindrical configuration defined by an upwardly extending skirt formed integrally with an elongated central tubular member, wherein said closure is a cap having marking means thereon for marking a panel engaged thereby for locating a hole for receiving said jig.

5. A sprinkler head jig according to claim 4 wherein: said marking means is a point on said head of said cap for engaging and marking a panel.

6. A sprinkler head jig for installing in a fitting for a sprinkler head during construction to enable a ceiling structure to be constructed therearound, comprising:

a body having external dimensions including a length and outer configuration conforming generally to those of a fire sprinkler head to be installed, an elongated central tubular member having a threaded upper end for installing in a sprinkler head fitting, a threaded lower end for receiving a closure cap, a passage communicating between said upper end and said lower end and cylindrical skirt means secured to the lower end of said tubular member and extending upward toward the upper end thereof for defining a surface around which a ceiling structure is constructed for defining a cavity for receiving a removable fire sprinkler head, wherein said closure is a cap having marking means thereon for marking a panel engaged thereby for locating a hole for receiving said jig.

7. A sprinkler head jig according to claim 6 wherein: said marking means is a point on said head of said cap for engaging and marking a panel.

8. A sprinkler head jig according to claim 6 wherein: said skirt has a length of about one and one-half inches and a diameter of about one and three-quarters inches.

9. A sprinkler head jig for installing in a fitting for a sprinkler head during construction to enable a ceiling structure to be constructed therearound, comprising:

a body having external dimensions including a length and outer configuration conforming generally to those of a fire sprinkler head to be installed, an elongated central tubular member having a threaded upper end for installing in a sprinkler head fitting, a threaded lower end for receiving a closure cap, a passage communicating between said upper end and said lower end and cylindrical skirt means secured to the lower end of said tubular member and extending upward toward the upper end thereof for defining a surface around which a ceiling structure is constructed for defining a cavity for receiving a removable fire sprinkler head, said body includes a hexagonal shaped tool engaging surface for receiving a tool to applying torque to said jig for installation and removal thereof from a pipe fitting.

10. A method for installing a fire sprinkler having removable sprinkler heads, comprising:

selecting and installing a water supply system including locating nipples with fittings for receiving sprinkler heads;

selecting and installing a jig in each of said fittings to enable a ceiling structure to be constructed therearound, said jig being selected to have a body having external dimensions including a length and outer configuration conforming generally to those of a fire sprinkler head to be installed, an elongated central tubular member having a threaded upper end for installing in a sprinkler head fitting, a threaded lower end for receiving a closure cap, a passage communicating between said upper end and said lower end and cylindrical skirt means secured to the lower end of said tubular member and extending upward toward the upper end thereof for defining a surface around which said ceiling structure is constructed for defining a cavity for receiving a removable fire sprinkler head;

constructing a ceiling structure around said jigs thereby forming a cavity for receiving a sprinkler head; and removing said jigs and installing sprinkler heads therefor.

11. A method according to claim 10 wherein:

said skirt has a length of about one and one-half inches and a diameter of about one and three-quarters inches.

12. A method according to claim 11 wherein:

said body includes a hexagonal shaped tool engaging surface for receiving a tool to applying torque to said jig for installation and removal thereof from a pipe fitting.

* * * * *